United States Patent [19]

Stelk

[11] Patent Number: 4,915,310

[45] Date of Patent: Apr. 10, 1990

[54] REPLACEABLE END CAP ASSEMBLY FOR THE SPIDER ARM OF A HAMMERMILL

[75] Inventor: John C. Stelk, Betendorf, Iowa

[73] Assignee: Sivyer Steel Corporation, Bettendorf, Iowa

[21] Appl. No.: 266,119

[22] Filed: Nov. 2, 1988

[51] Int. Cl.[4] ..... B02C 13/28

[52] U.S. Cl. ..... 241/197; 241/194

[58] Field of Search ..... 241/191, 194, 197, 195

[56] References Cited

U.S. PATENT DOCUMENTS

| | | | |
|---|---|---|---|
| 3,727,848 | 4/1973 | Francis | 241/194 |
| 3,844,494 | 10/1974 | Hightower | 241/194 |
| 4,222,530 | 9/1980 | Whitney | 241/194 |

*Primary Examiner*—Joseph M. Gorski

*Attorney, Agent, or Firm*—Foley & Lardner

[57] ABSTRACT

A replaceable, protective end cap assembly for the end of a spider arm for a rotary hammer assembly, the end cap assembly including a side plate assembly and a protective cap. The side plate assembly including a pair of side plates connected by upper and lower cross members that matingly engage the leading edge of the spider arm with the side plates covering the side wall surfaces in the impact area of the spider arm. The protective cap includes a shroud that overlies the front surface of the spider arm as well as the peripheral edges of the side plates and the side plate assembly and end caps being retained on the spider arms by the hammer shaft.

2 Claims, 3 Drawing Sheets

REPLACEABLE END CAP ASSEMBLY FOR THE SPIDER ARM OF A HAMMERMILL

BACKGROUND OF THE INVENTION

1. Field of the Invention

This invention relates generally to hammer mills and particularly heavy duty hammer mills of the type used to break up discarded automobile bodies. The invention is specifically related to a replaceable, protective end cap assembly for the spider arm and more particularly to a side wall guard for the spider arm.

2. Description of the Prior Art

Hammermills of the type contemplated herein are widely used to reduce large metal objects such as cars into small fragments in a short time. This is of particular importance in reducing automobile bodies into manageable pieces for scrap recovery. These shredders generally include a housing, a hammer assembly mounted for rotary motion in the housing and a drive means for rotating the hammer assembly past grate bars which cooperate with the hammers to fragmentize or shred the metal objects.

It has been generally known that the life of the spider arms is limited due to the continuous impact of the end of the of the spider arms by the fragmentized metal. Repair of the spider arms requires a complete shut down and disassembly of the hammer mill before it can be returned to production. A complete shut down of the hammer mill can be costly not only for repair but also in loss of production time.

The life of the spider arms has been extended by the use of protective caps or tips which are mounted on the impact area of the face of the spider arms. It has, however, been found that the side walls of the spider arms are also subject to considerable wear from the flying metal pieces. The following patents describe various types of end caps that have been used to protect the face of the spider arms.

In the Francis Pat. No. 3,727,848 entitled "Hammer Mill with Replaceable Spider Arm Tips" issued Apr. 17, 1973, a protective tip or cap is described for protecting the nd of a spider arm. The cap in this patent includes a crescent shaped shroud portion which overlies the tip of the spider arm and a web portion which is positioned in a socket provided in the outer end portion of the spider arm. This type of cap has proven to be effective in protecting the tip of the spider arm however it does not protect the side walls of the spider arm.

In the Whitney Pat. Nos. 4,290,545 and 4,222,530 entitled "Replaceable Protective Means for End Disk of Shredder" issued Sept. 16, 1980 and "Method of Attaching A Protective Cap to a Shredder Component" issued Sept. 22, 1981, respectively, a replaceable protective cap is provided on the end disk of the rotary shredder assembly. The protective cap being formed of a wear resistant metal having a U-shaped configuration for covering the curved portion of the periphery of the end disks on the shredder assembly. The cap is described as including a dependent skirt which is designed to protect the interior areas of the end disk which are subject to wear. There is no provision for protecting the side walls of the spider arms in either of these patents.

The Hightower Pat. No. 3,844,494 entitled "Hammer Mill Rotor Assembly" issued Oct. 29, 1974, discloses a hammermill having heavy hammers mounted on the rotors forward of the centerline of the rotor. When the hammers are worn, they are moved to a pivot point on the center line of the rotor. The rotor is then cut down on the face and the sides to accomodate a replacable cap. The cap protecting the impact area both of the face and the sides of the rotor from wear. The cross sectional area of the spider arm is reduced in order to mount this cap on the spider arm. The cap is in the form of a unitary structure that is used to protect the rotor when the hammers are modified for movement to the center of the spider arms. This cap is made of a high strength steel and must be replaced in its entirety when it becomes worn or damaged.

SUMMARY OF THE INVENTION

The replaceable protective end cap assembly of the present invention provides not only for protection of the impact area on the tip of the spider arm but also protects the impact area in the side walls of the spider arm from wear. This is accomplished by providing a two piece assembly which includes a replaceable side plate assembly and a replaceable tip or cap. The replaceable cap interengages with the side plate assembly on each side of the spider arm to provide a protective cover around the impact area at the lead edge of the spider arm. The replacement side plate assembly can be repaired or replaced separately from the cap without disassembly of the entire hammer mill.

A primary feature of the invention is the interengagement of the protective end cap assembly with the side plate assembly when mounted on the end of the spider arm. The side plate assembly providing a seat for the interior contoured surface of the end cap in order to protect the corners of the spider arms.

A further feature of the invention is the ability to repair the individual spider arms without disassembling the hammer assembly. This results in a reduction of down time for repair of the hammer mill as well as an increase in productive time of the hammermill.

Another feature of the invention is the use of the hammer shaft for holding both the replaceable cap and side plate assembly on the spider arm whereby both assemblies can be serviced at the same time.

Another feature of the invention is the ability to replace either one of the end cap or side plate assembly or both depending on wear resulting in a further cost saving.

Other principal features and advantages of the invention will become apparent to those skilled in the art upon review of the following detailed description, claims and drawings.

DESCRIPTION OF THE PREFERRED EMBODIMENT

Figure 1:
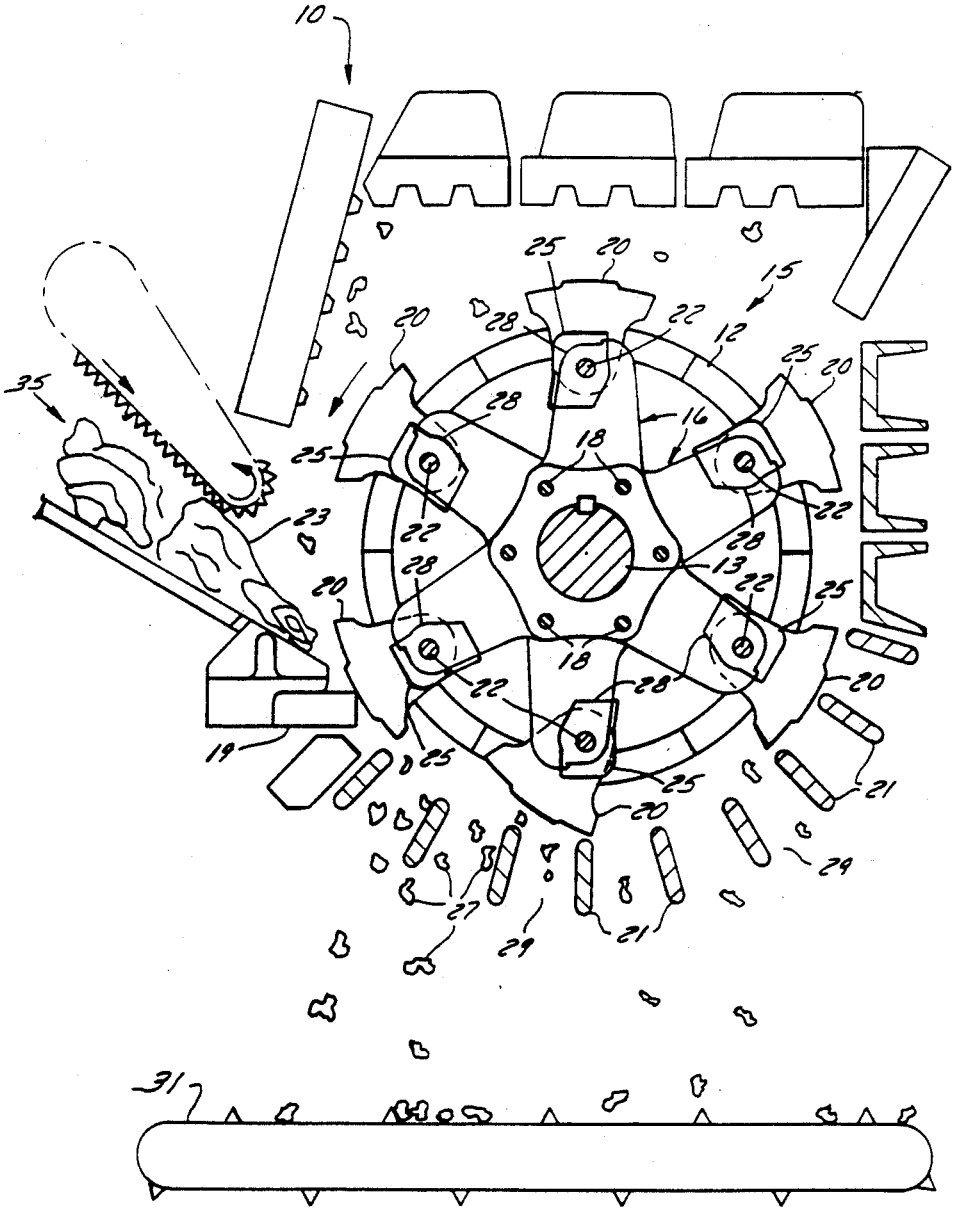
FIG. 1 is an end view in section of a shredder embodying the present invention.
Figure 2:
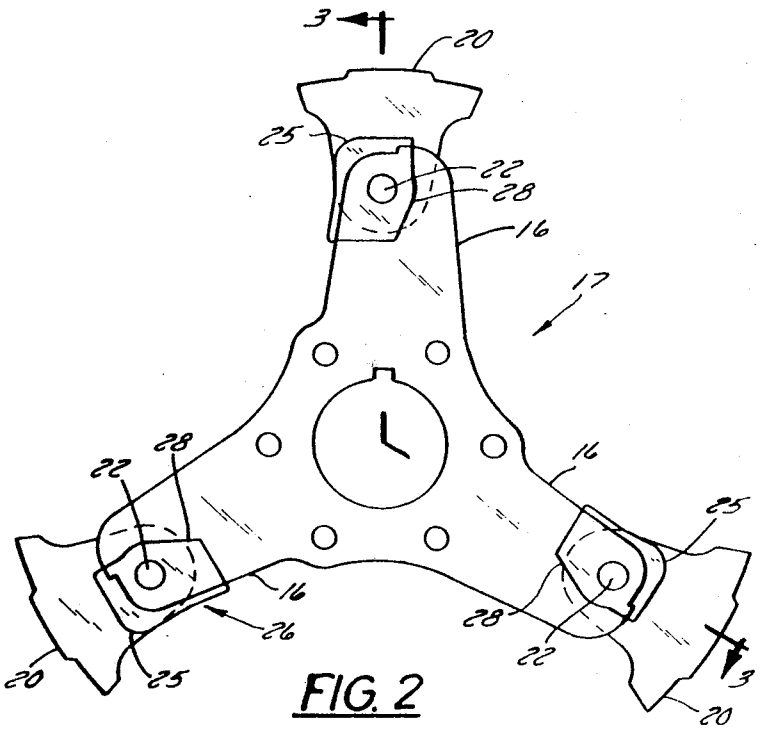
FIG. 2 is an end view of the spider assembly.
Figure 3:
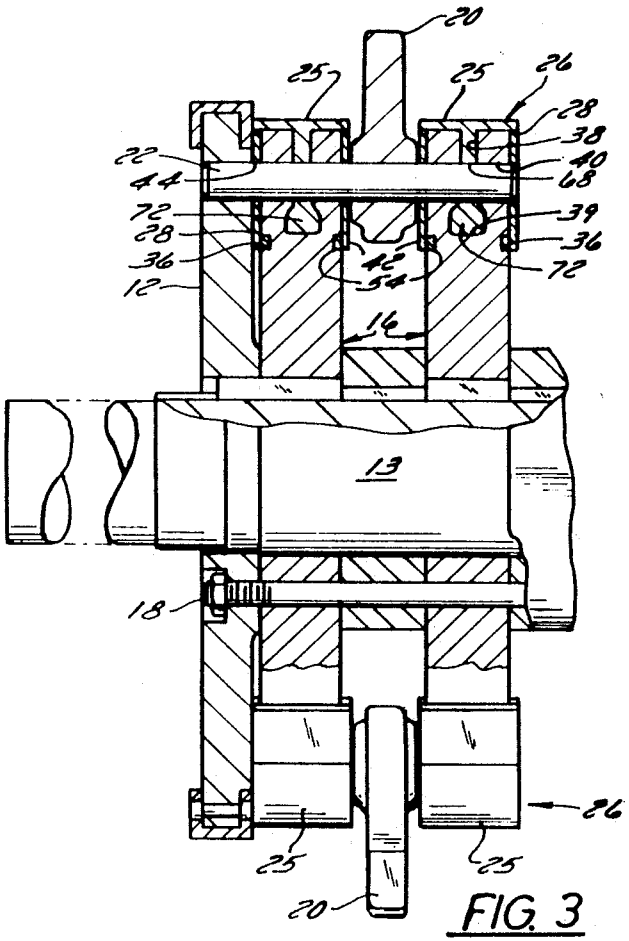
FIG. 3 is a partial sectional view taken on line 3—3 of FIG. 2 showing the rotary hammer assembly.
Figure 4:
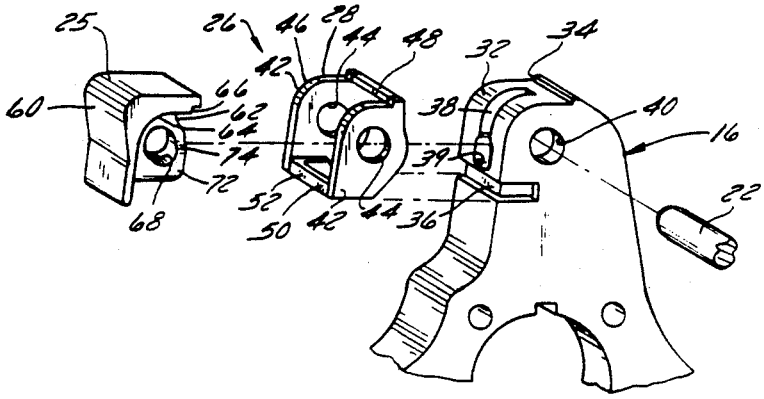
FIG. 4 is an exploded perspective view of a portion of the spider arm, the side plate assembly and the protective tip according to the invention.
Figure 5:
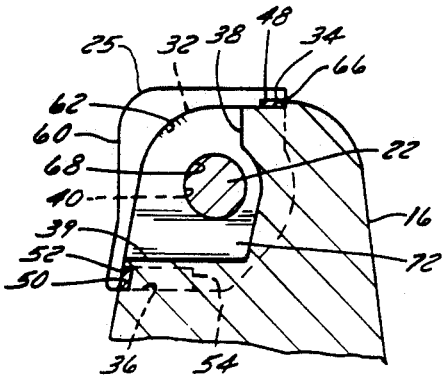
FIG. 5 is a sectional view of a portion of the end of the spider arm showing the mounting of the side plate assembly and contoured tip on the contoured end of the spider arm.
Figure 6:
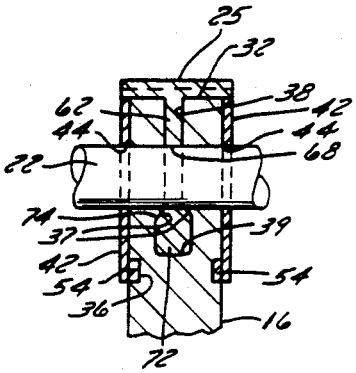
FIG. 6 is a view partly in section showing the relation of the hammmer shaft to the end cap assembly Before describing one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

Shredders 10 of the type contemplated herein, as shown in the drawings, generally include a rotary hammer mill assembly 15 which is formed by a number of spiders 17 each having three arms 16 and a pair of end disks 12 which are mounted on and keyed to a shaft 13. The shaft 13 is supported in bearings (not shown) that are structurally mounted in the side walls of the shredder housing. The spider arms 16 and end disks 12 are secured together by means of tie rods 18. As is generally understood in the art, each alternate pair of spider arms 16 is off set from the adjacent pair of spider arms 16 to provide room for the hammers 20. As seen in FIG. 1, the hammers 20 are mounted on shafts 22 which pass through holes 40 provided in the ends of the spider arms 16.

In operation, the free swinging hammers 20 rotate with the rotary hammer assembly 15 and co-act with the teeth of a rigidly mounted cutting comb 19 that extends the length of the rotary hammer assembly 15 and with the grate bars 21 that are circumferentially spaced about the lower part of the orbit of the hammer circle to break up any material 23 entering the shredder through inlet 35. When the pieces or fragments 27 reach a desired size, they fall through the spaces 29 between the grate bars 21 onto a delivery conveyor 31 which carries them from the shredder housing.

The hammers 20, comb 19 and grate bars 21 are formed of specially hardened steel. The spiders 15 and end disks 12 are cast of a softer steel. Although in operation the hammers 20, comb 19 and grate bars 30 are exposed to the most impact and wear associated with the shredding of scrap objects, the shredder pieces 27 come in constant contact with the side walls of the spider 17 and generally in the area of the impact edge of the arms 16.

In accordance with the present invention, each of the spider arms 16 is provided with an end cap assembly 26 which protects both the impact area on the face of the spider arm 16 as well as the impact area on the side walls of the spider arm 16 from wear. Each end cap assembly 26 includes an end cap 25 and a side plate assembly 28 which are mounted to protect the impact area at the top of the spider arm 16.

In this regard it should be noted that the end of each of the spider arms 16 is provided with a curved surface 32 which terminates at the tip of the arms 16 at a step 34 and on the face of the spider arm 16 at a groove 36. A socket 38 is provided in the front face of the curved surface 32 which includes an enlarged opening 39 at the lower end to provide an abutment 37 on each side of the slot 38. A hole 40 is provided through the side walls of the spider arm 16.

The side plate assembly 28 includes two plates 42, each having a hole 44 which corresponds to the hole 40 in the spider arm 16 and a peripheral contour 46 that corresponds to the contour of the curved surface 32 at the top of the spider arm 16. The plates 42 are joined at the top by a cross member 48 and at the bottom by a U-shaped member 50. The side plates 42 are formed of a hard, wear resistant steel to protect the softer cast steel arms 16 of the spider 17.

In this regard, it should be noted that the U-shaped member 50 includes a bar 52 having a pair of legs 54. The bar 52 and legs 54 conforming to the shape of the groove 36 provided in the face of the spider arms 16. On assembly, side plate assembly 28 is positively locked on the spider arm by the engagement of the cross member 48 with the step 34 at the top of the spider arm 16 and the seating of the U-shaped member 50 in the slot or groove 36 in the face of the spider arm 16.

It should be noted that the side plates 42 are mounted on the outside surface of the spider arms 16 to provide protection from impact as well as providing a bearing surface for the hammer. With this arrangement, the strength of the spider arm is maintained since there is no reduction in the cross sectional area of the spider arms 16.

The replaceable end cap 25 includes a contoured shroud 60 and a web 62. The inner surface 64 of the contoured shroud 60 having a curvature corresponding to the curved surface 46 of the side plates 42 to provide a close fit with the side plates. A notch 66 is provided at the upper edge of the shroud which matingly engages and protects the cross member 48 and the side plate assembly 28 from damage. The web 62 includes an opening 68 which is of the same diameter as the opening 44 in the side plates 42 and the opening 40 in the spider arm 16 to accomodate the hammer shaft 22. The web 62 has a thickness which corresponds to the thickness of the slot 38 in the top of the spider arm 16 and an enlarged contoured section 72 that matingly engages the opening 39 at the lower end of the slot 38 in the spider arm 16. The contoured section 72 including abutment surfaces 74 which engage the abutments 37 provided on each side of opening 39 to hold the cap in a fixed position in the spider arm. The end cap assembly is fixed in position by the hammer shot 22 which passes through holes 44 and 68 in the end cap assembly.

Repair or replacement of the cap 25 or side plate assembly 28 is accomplished by removing the hammer shaft 22 and hammers 20 from the hammer assembly 15. The caps 25 are removed and inspected for wear. The side plate assemblies 28 are inspected and replaced only if they require replacement. The caps 25 are repositioned on the side plate assemblies 28. The hammers 20 are then mounted on the shafts 22 to secure the caps and side plate assemblie on the spider arms 16.

It will be understood that the foregoing description is of a preferred exemplary embodiment of the present invention and that the invention is not limited to the specific forms shown. Modifications may be made in design and arrangement thereof within the scope of the present invention, as expressed in the following claims.

I claim:

1. A replaceable, protective end cap assembly for protecting a curved end and sides of a spider arm for a hammer mill, said assembly comprising:

a side plate assembly including a pair of side plates having curved edges conforming to the curved end of the spider arm and overlying the sides of the spider arm, and a protective cap mounted on the curved end of the spider arm in abutting engagement with said side plates, said cap including a contoured shroud having a curvature corresponding in shape to the curved edges of said side plates, and a web matingly engaging a correspondingly configures slot in the end curved of the spider arm, wherein said side plate assembly includes means for aligning said side plate assembly on the sides of the spider arm, said aligning means including a U-shaped member interconnecting said side plates at their bottoms and a cross member interconnecting said side plates at their tops.

2. The assembly according to claim 1 including means for securing said end protective cap and side plate assembly to said spider arm.

* * * * *